United States Patent [19]

Landuydt

[11] 4,263,923

[45] Apr. 28, 1981

[54] PERFORATOR FOR A SINGLE CIGARETTE

[76] Inventor: Louis J. Landuydt, 6, rue Maty, Obaix 6249, Belgium

[21] Appl. No.: 30,319

[22] Filed: Apr. 16, 1979

[30] Foreign Application Priority Data

Apr. 20, 1978 [LU] Luxembourg ..... 79479

[51] Int. Cl.[3] ..... A24F 13/00; A24F 25/00; A24F 47/00

[52] U.S. Cl. ..... 131/254; 131/329

[58] Field of Search ..... 131/170, 254, 253, 188, 131/233, 178, 185

[56] References Cited

U.S. PATENT DOCUMENTS

| | | | |
|---|---|---|---|
| 1,999,688 | 4/1935 | Elliott | 131/254 |
| 2,653,614 | 9/1953 | Coffey | 131/254 X |
| 2,854,010 | 9/1958 | Stamm | 131/170 R |
| 2,983,044 | 5/1961 | Stein | 131/170 R |
| 3,918,462 | 11/1975 | Laito | 131/170 R |

*Primary Examiner*—Stephen C. Pellegrino

*Attorney, Agent, or Firm*—Hume, Clement, Brinks, Willian & Olds, Ltd.

[57] ABSTRACT

A perforator for a single cigarette is disclosed. The perforator includes a support-base having a projection extending from one of its sides. The projection has a notch adapted to freely receive a cigarette adjacent to the support-base. A pin projects from the support-base on the same side as the projection, facing the notch for insertion into a cigarette positioned in the notch.

18 Claims, 13 Drawing Figures

PERFORATOR FOR A SINGLE CIGARETTE

BACKGROUND OF THE INVENTION

The present invention relates to a cigarette perforator. More particularly the invention relates to a perforator for a single cigarette.

It is well known that the content of tar, of nicotine and of other harmful materials in cigarette smoke can be reduced by providing one or more perforations in the sheet enclosing the tobacco, below the part designed for being placed between the lips. In fact, it has been observed that the harmful materials contained in the smoke may be diluted through the introduction of a quantity of cold, fresh air sucked in through the perforations.

A perforator for a single cigarette is known, comprising a support-base, a projection extending on one side of the support-base and possessing at least one notch for housing the cigarette, adjacent to the support-base, and at least one pin, projecting in relation to the support-base, on the same side as the projection and facing the notch, for insertion into the paper of the cigarette when the latter is placed in the notch.

In this perforator of the above-mentioned type, the notch for the housing of the cigarette is formed by two longitudinal, parallel, curved projections, flexible to each other and brought together, so that the cigarette has to be vigorously inserted between the curved parts when it is placed in its housing, so that these parts enclose the cigarette when it is pressed on to the pin.

The result is that it is necessary to separate the edges of the projections from each other with one's two hands, in order to place the cigarette in its housing before perforation or to withdraw it from its housing after perforation. Thus it is not possible to allow the cigarette to rest freely in its housing and to perforate it in one single operation. Besides, there is a risk of breaking the cigarette during this vigorous insertion or during its removal after perforation.

In another known embodiment, the housing is made up of a tubular casing, while the pin is controlled by a mechanism fixed in the casing, which can be manually operated for causing it to penetrate into the cigarette.

In order to perforate the cigarette with a perforator of this kind, therefore, it is again necessary to proceed in two successive steps; i.e., the cigarette is placed in its housing and then perforated by manipulating a perforation mechanism. With this kind of perforator, the place of the perforation of the cigarette is not visible from the outside and its position is determined by a lug, the location of which has to be altered if it is desired to change the place of the perforation. This kind of perforator is not only difficult to operate, but is complicated and expensive to manufacture and its bulk is too large for being mounted on a lighter of the disposable type. The present invention has as its object a perforator that does not possess these shortcomings.

SUMMARY OF THE INVENTION

According to the invention, the sides of the notch are sufficiently far apart from each other to permit the notch to freely receive at least a part of the periphery of a cigarette and to permit simultaneous perforation of this part by the pin in the notch.

According to one aspect, the projection consists of a first collar in contact with the support-base. This feature makes it possible to protect the user of the pin.

According to another aspect, the first collar also includes a second notch opposing the first notch and having a configuration substantially similar to the first notch. This design enables the user to perforate the cigarette at different places along its length.

In any event, the perforating pin is preferably located adjacent to the housing-notch in the projection or collar. In this position, the pin is protected by the collar. When the perforator is put into one's pocket, damage to the pin by other objects present in the pocket, such as keys, coins etc., is avoided.

When two notches are utilized, these notches preferably form the ends of a groove in the support-base, which is adapted to receive less than the entire periphery and length of the cigarette. Thus the cigarette may be supported between the two notches. This avoids bending of the cigarette when it is pressed on to the pin.

According to another aspect, the perforator includes means by which it fits on to one of the ends of a lighter.

Other details and features of the invention will become clear in the course of the description of the drawings which represent embodiments of the invention, diagrammatically and only by way of examples.

DETAILED DESCRIPTION OF THE PREFERRED EMBODIMENTS

Figures 1, 2, 3, 4, 5, 6, 7, 8, 9, 10, 11, 12, 13:
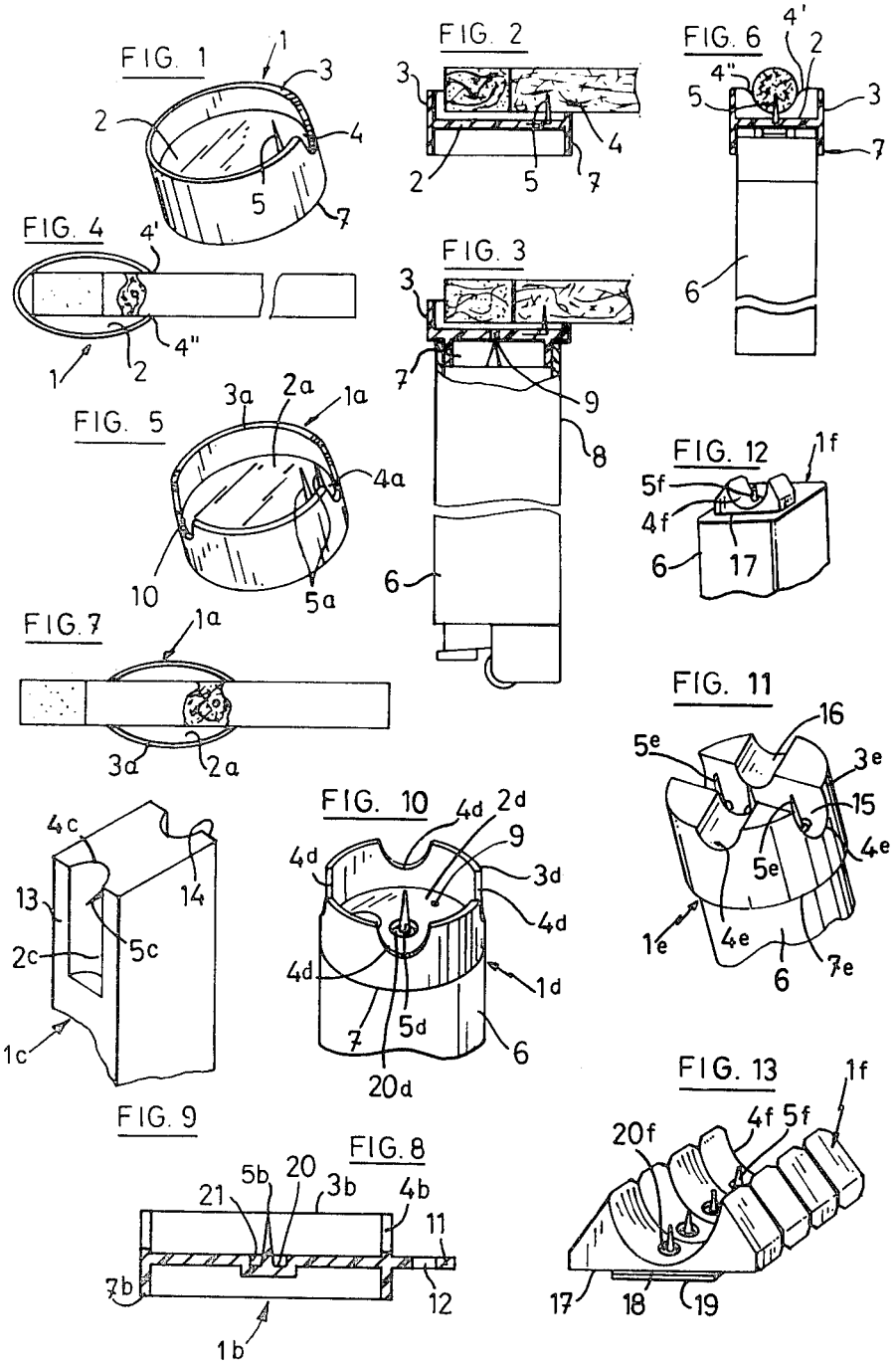
FIG. 1 is a view in perspective of a perforator, possessing a single notch for receiving a cigarette.
FIG. 2 is a sectional elevation view showing a cigarette positioned in the notch.
FIG. 3 is a sectional elevation view showing a slightly modified perforator mounted to a cigarette lighter, thereby forming its base.
FIG. 4 is a plan view of the embodiments shown in the FIGS. 1–3.
FIG. 5 shows in perspective a perforator, having two notches for receiving a cigarette, and two pins for perforating the cigarette.
FIG. 6 is a sectional elevation view of the embodiments depicted in FIGS. 1–2 and 4–5, shown as being mounted to the end of a cigarette lighter.
FIG. 7 is a plan view of the perforator shown in FIG. 5.
FIG. 8 is a sectional elevation view of a perforator possessing a connecting strap.
FIG. 9 is a perspective view of a perforator fitted to the side of a lighter.
FIGS. 10 to 13 are perspective views of other embodiments of the invention.

In this detailed description similar elements in different embodiments are identified by the same numeral suffixed by different letters.

A first embodiment of the perforator for a single cigarette is shown in FIGS. 1 to 4 by the reference numeral 1. This perforator comprises a support-base 2 having a projection 3 which extends on one side of the support-base. This projection 3 has a single notch 4, adjacent to the support-base for receiving a cigarette to be perforated.

A pin 5 extends from the same side of the support-base 2 as does the projection 3. This pin 5 faces the notch 4, and is adapted for insertion through the paper of the cigarette when the latter is placed in the notch 4, as shown in FIG. 2. The pin 5 is preferably adjacent to the notch 4 as depicted in FIGS. 1 to 4.

The sides 4' and 4" of the notch 4 are sufficiently far apart from each other that the notch can freely receive at least a part of the periphery of the cigarette. As the cigarette is positioned in the notch 4, it is perforated by the pin 5. The term "freely receive" as used herein is intended to mean that the width of the notch is such that it is not necessary to separate the sides of the notch prior to the introduction of the cigarette in the notch.

The pin is placed on the support-base 2 sufficiently far from the side of the projection opposite to the notch 4, so that when the cigarette is placed with its adjacent end against the side of the projection opposite to the notch, perforation of the paper takes place below the part of the cigarette designed for being placed between the lips.

The projection 3 preferably constitutes a first collar around the periphery of the support-base 2, making it possible to protect the pin 5 against objects that may be present in the pocket of the smoker at the same time, such as keys or coins, and thus preventing the smoker from possibly injuring his fingers when putting his hand into his pocket.

As shown in FIG. 3, the perforator possesses means for mounting the perforator to one end of a cigarette lighter 6. To this end, the perforator possesses a second collar 7 extending from the base 2, on the side of the base which is opposite the projection or first collar 3. In the embodiment shown in FIG. 3, this second collar 7 fits on to an inner wall 8 of the lighter, so as to form the bottom of the latter.

The support-base 2 preferably possesses an aperture 9 for the admission of fuel into the body of the lighter. This aperture 9 may include a simple valve (not shown) of conventional design.

The first and second collars 3 and 7 of the perforator 1 can be circular in section as shown in FIG. 1, oval, as shown in FIG. 4, or any other shape so as to fit on to the section of the end of the lighter. In any event, the projection or first collar 3 makes it possible to more firmly place the lighter 6 on a piece of furniture, than when the bottom of the lighter is flat.

A second embodiment of the perforator has been illustrated in FIGS. 5 to 7. In this embodiment, the perforator 1*a* possesses a second notch 10 diametrically opposed to the first notch 4*a*. This second notch 10 is of substantially similar configuration as the first notch 4*a*. In this embodiment the cigarette to be perforated is simultaneously placed in these two notches 4*a* and 10. The second notch 10 makes it possible, as shown in FIG. 7, to move the cigaret lengthwise in relation to the pin 5*a*, so as to be able to provide perforations at several places on its length. Several pins 5*a* may be provided as shown in FIG. 5 for simultaneously perforating several holes.

In the embodiments of FIGS. 2 and 6, the second collar 7 comprises an extension of the first collar 3. With this design, the perforator may be adapted to fit to either the top or bottom of the lighter 6.

In the embodiments shown in FIGS. 1 to 6, the pins 5 and 5*a* are preferably formed of metal, while the remainder of the perforator is developed in synthetic plastics or in one piece of stamped metal.

In the embodiment of FIG. 8 indicated generally as 1*b*, the pin 5*b* is conical and is in one piece with the projection and the support-base in synthetic plastics. To give the pin 5*b* greater resistance to accidental dislocation, it is possible to give it a wider base without increasing the useful section serving for perforating holes in the cigarette. To this end, the support-base is provided with an underlying round cavity 20 from which the pin 5*b* emerges. The side 21 of this cavity thereby to some extent protects the somewhat recessed pin 5*b* from breakage. The perforator 1*b* may be provided with a strap 11 possessing an opening 12, for attachment to any body, such as a small chain, a key-ring, etc.

In the embodiment of FIG. 9, a perforator 1*c* according to the invention has been fitted to each of the side walls 13 and 14 of a lighter, only the lower part of which has been shown. The support-base 2*c* of the perforator 1*c* is formed by the bottom of a notch 4*c*, which extends over a length corresponding to part or to the whole length of the cigarette. The walls defined by the notch 4*c* form a housing into which at least a part of the periphery and length of the cigarette may be inserted. Preferably the perforator on the side 13 is equipped with a single pin 5*c*, while the side 14 includes two or more pins (not shown).

In the embodiment of FIG. 10, the second collar 7*d* of the perforator 1*d* is mounted in the extension of the cylindrical wall of a lighter, with which it is made in one piece. The first collar 3*d* possesses two pairs of notches 4*d* diametrically opposited to each other. Each pair of notches has a different depth. The pin 5*d* is conical and is positioned at the center of the support-base 2*d*, which forms the bottom of the lighter. The result is that when the cigarette is placed in the deeper pair of notches, a perforation of larger section is obtained than when it is placed in the shallower pair of notches.

In the embodiment of FIG. 11 the perforator, indicated generally at 1*e*, includes two pairs of diametrically opposed notches 4*e*. These notches 4*e* define and form the ends of first and second grooves 15 and 16. The grooves 15 and 16 make it possible to support the cigarette along its whole length between the two pairs of notches. The grooves 15 and 16 are normal to each other and are of different depths. The first groove 15 is shown as being deeper and is equpped with a conical central pin 5*d*. Additional identical pins 5*d* may be provided on both sides of the central pin 5*d*. Here again, the result is that when the cigarette is placed in the deepest groove 15, it is inserted on to the pin to a greater penetration depth than when it is placed in the shallower groove 16. Holes of varying section and number are thus obtained, depending upon which groove is selected by the user.

In the embodiment of FIGS. 12 and 13, the perforator 1*f* includes a plane outer face 17 which is equipped with a self-sealing adhesive tape 18. This adhesive tape 18 is temporarily covered with a protective tape 19, which can be torn off at the moment of its application, for example, when the perforator 1*f* is fixed on to a disposable object, for example a cigarette packet or a lighter.

The perforators 1*f* of the kind illustrated in FIG. 12 can be advantageously produced continuously by molding in synthetic plastics, for example, in polyethylene, so as to form a rod as shown in FIG. 13. These perforators 1*f* are joined to one another at the base during the molding operation and, with a view to their separation, possess reduced portions. These perforators 1*f* can also be joined to one another by the adhesive tape 18.

The original idea and the great case of manufacture and use of the perforators described above, with a low cost price, lend themselves advantageously to their application to objects disposable after use, such as lighters and cigarette packets, match-boxes and matchbooks.

I claim:

1. A cigarette perforator for a lighter having a wall at one end thereof, said perforator comprising:

a support base;

a projection, extending from a first side of the support base, which defines a first notch sized to receive a cigarette freely;

a pin projecting from the first side of the support base and aligned with the first notch such that the pin is positioned to perforate a cigarette placed in the first notch; and a first collar extending from a second side of the support base, opposed to the first side, the shape of the first collar matching the shape of the lighter wall such that the first collar is sized to fit onto the lighter wall.

2. The invention of claim 1 wherein the first collar is sized to fit within the lighter wall such that the support base forms the bottom of the lighter, and further, wherein the support base further comprises a valved aperture adapted to admit lighter fuel into the interior of the lighter.

3. The invention of claim 1 wherein the projection defines a second notch sized to receive a cigarette freely and wherein the second notch is opposed to the first notch such that the pin is situated between the first and second notches.

4. The invention of claim 1 wherein the pin is situated adjacent the first notch.

5. The invention of claim 1 wherein the pin is recessed with respect to the projection to protect the pin from breakage.

6. The invention of claim 1 wherein the projection comprises a second collar, which forms an extension of the first collar.

7. The invention of claim 1 or 2 wherein the first notch comprises a first groove situated diametrically with respect to the first collar and further, wherein the pin is positioned to extend within the first groove.

8. The invention of claim 7 wherein the projection further defines a second groove, positioned at an angle with respect to the first groove and having a depth which differs from that of the first groove, and further, wherein the pin is positioned at the intersection of the first and second grooves and is provided with a cross-sectional area which progressively decreases in the direction of the tip of the pin such that a cigarette is perforated more deeply when placed in the deeper groove and less deeply when placed in the shallower groove and the cross-sectional area of the cigarette perforation is varied accordingly.

9. A cigarette perforator for a lighter having a wall at one end thereof, said perforator comprising:

a support base;

a projection secured to a first side of the support base, said projection defining a first groove and a second groove oriented at an angle with respect to the first groove such that the first groove intersects the second groove, said first groove being deeper than said second groove;

a pin extending away from the first side of the support base at the intersection of the first and second grooves, said pin tapered such that the cross-sectional area of the pin progressively decreases in the direction of the tip of the pin and the pin forms a perforation having a greater cross-sectional area when a cigarette is placed in the first groove than when a cigarette is placed in the second groove; and a collar extending from a second side of the support base, opposed to the first side, said collar sized such that the shape of the collar matches that of the lighter wall and the collar fits onto the lighter wall.

10. The perforator of claim 8 or 9 wherein at least one of said grooves includes a plurality of pins.

11. The invention of claim 9 wherein the pin is recessed with respect to the projection such that the pin is protected from breakage.

12. A cigarette perforator for a lighter having a wall at one end thereof, said perforator comprising:

a support base;

a first collar secured to the support base such that the first collar extends from a first side of the support base, said first collar defining at least one notch sized to receive a cigarette freely;

a pin secured to the first side of the support base within the first collar such that the pin is aligned with the at least one notch and is positioned to perforate a cigarette placed in the at least one notch; and a second collar secured to the support base such that the second collar extends from a second side of the support base, opposed to the first side, said second collar sized such that the shape of the second collar matches the shape of the lighter wall and the second collar fits onto the lighter wall.

13. The invention of claim 12 wherein the cross-sectional shape of the first collar matches that of the second collar and the second collar is sized to fit around the lighter wall.

14. The invention of claim 12 wherein the cross-sectional size of the second collar is smaller than that of the lighter wall and the second collar fits within the lighter wall.

15. The invention of claim 12 wherein the at least one notch comprises a groove situated diametrically with respect to the first collar, and, further, wherein the pin is positioned to extend within the groove.

16. The invention of claim 12 wherein the pin is situated adjacent the at least one notch.

17. The invention of claim 12 wherein the at least one notch includes two opposed notches situated on the collar such that the pin is situated therebetween.

18. The invention of claim 12 wherein the pin is recessed with respect to the first collar such that the pin is protected from breakage.

* * * * *